US005642881A

United States Patent [19]

Stennett

[11] Patent Number: 5,642,881

[45] Date of Patent: Jul. 1, 1997

[54] TRI-HOLLOW RACKET WITH TRAVERSE RIBS

[75] Inventor: Patrick Stennett, Springfield, Mass.

[73] Assignee: Lisco, Inc., Tampa, Fla.

[21] Appl. No.: 595,779

[22] Filed: Feb. 2, 1996

[51] Int. Cl.[6] ..... A63B 49/12

[52] U.S. Cl. ..... 473/537; 473/545

[58] Field of Search ..... 273/73 R, 73 C, 273/73 H, 73 K

[56] References Cited

U.S. PATENT DOCUMENTS

| | | | |
|---|---|---|---|
| 1,611,232 | 12/1926 | Reach | 273/73 H |
| 1,618,727 | 2/1927 | Reach | 273/73 H |
| 3,752,478 | 8/1973 | Flak | 273/73 H |
| 5,172,911 | 12/1992 | Chang | 273/73 H |
| 5,184,818 | 2/1993 | Lo | 273/73 H |
| 5,217,223 | 6/1993 | Feeney | 273/73 H X |
| 5,219,166 | 6/1993 | Chang | 273/73 H |
| 5,358,261 | 10/1994 | Cheng | 273/73 H |
| 5,409,215 | 4/1995 | You | 273/73 H X |
| 5,460,370 | 10/1995 | Tung-Han | 273/73 H |

FOREIGN PATENT DOCUMENTS

| | | | |
|---|---|---|---|
| 3715414 | 12/1988 | Germany | 273/73 H |

*Primary Examiner*—William E. Stoll

[57] ABSTRACT

A racket frame of extruded aluminum with a common cross-section along its entire length. The frame has free ends with frame portions adjacent to the free ends shaped parallel with each other to constitute a handle. The frame is shaped in a curved configuration remote from the handle with a central opening therewithin to form a head. The opening has a central axis. The frame is shaped with a transition zone between the head and the handle. The cross-section of the frame is of an exterior closed configuration with a major axis parallel with the central axis and a minor axis perpendicular to the major axis. The cross-section of the frame has two interior ribs spaced from each other to divide the cross-sectional configuration into three linear openings with the ribs being angled equally and oppositely with respect to each other.

8 Claims, 3 Drawing Sheets

FIG 3
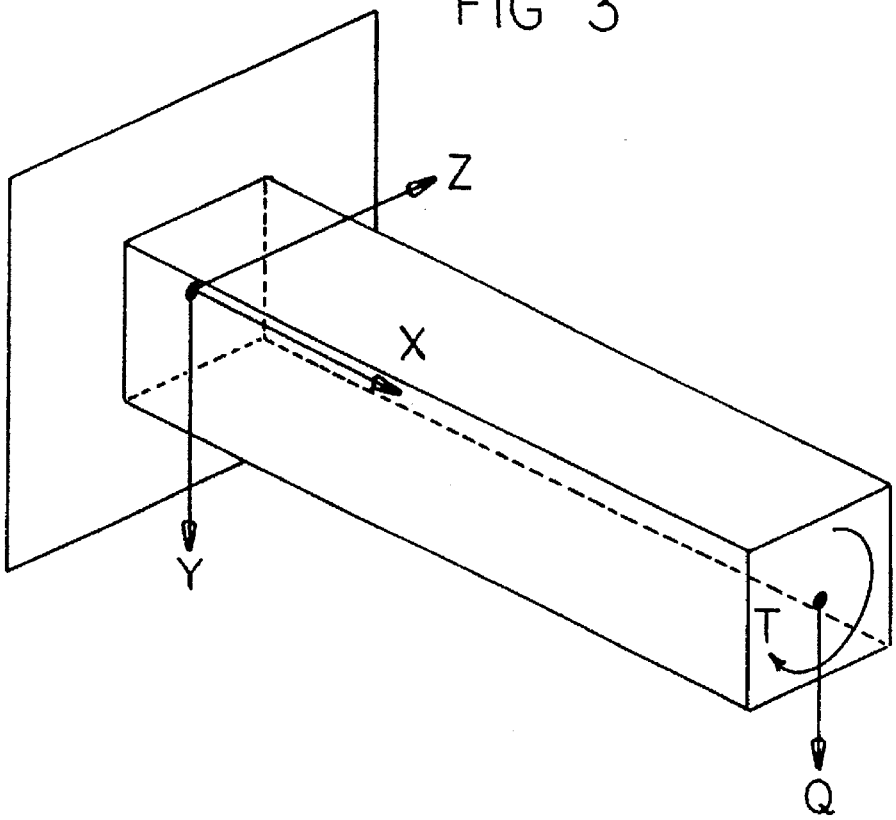
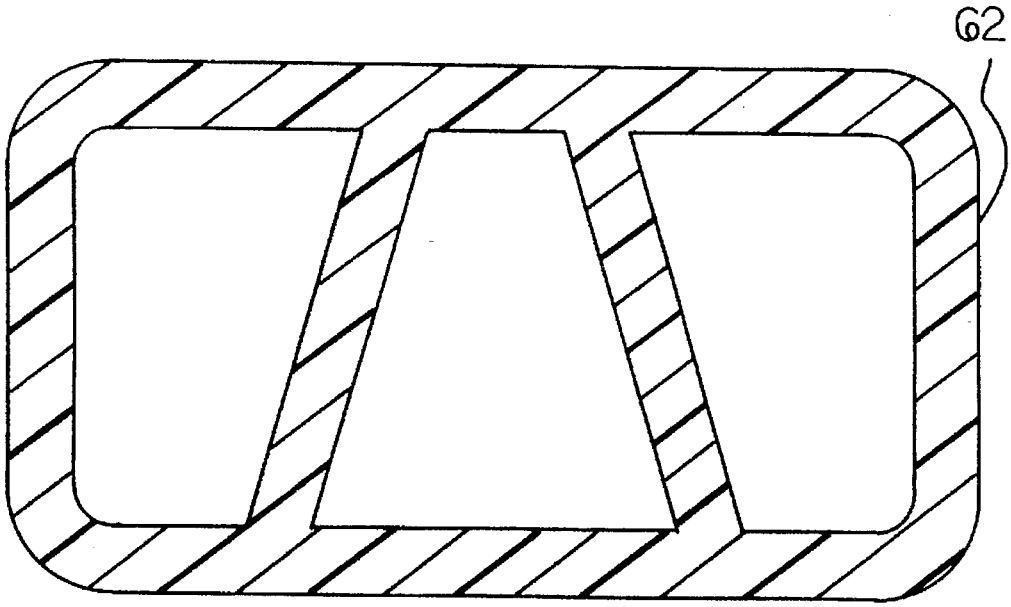
FIG 4

TRI-HOLLOW RACKET WITH TRAVERSE RIBS

BACKGROUND OF THE INVENTION

1. Field of the Invention

This invention relates to a tri-hollow racket with traverse ribs and, more particularly, to enhancing the performance characteristics, playability, feel, comfort, and durability of an extruded racket frame.

2. Description of the Prior Art

The use of rackets with frames of various designs and configurations are known in the prior art. More specifically, rackets with frames of various designs and configurations heretofore devised and utilized for the purpose of improving the playing characteristics of rackets by various methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art in U.S. Pat. No. 4,278,251 to Lafourcade discloses a racket frame for game balls. U.S. Pat. No. 3,752,478 to Flak discloses a racket frame. U.S. Pat. No. 1,930,285 to Robinson discloses a built-up metal tube. Lastly, U.S. Pat. No. Des. 253,418 to Cosmos discloses an ornamental design for a game racket.

In this respect, the tri-hollow racket with traverse ribs according to the present invention substantially departs from the conventional concepts and designs of the prior art, and in so doing provides an apparatus primarily developed for the purpose of enhancing the performance characteristics, playability, feel, comfort, and durability of an extruded racket frame.

Therefore, it can be appreciated that there exists a continuing need for new and improved tri-hollow racket with traverse ribs which can be used for enhancing the performance characteristics, playability, feel, comfort, and durability of an extruded racket frame. In this regard, the present invention substantially fulfills this need.

SUMMARY OF THE INVENTION

In view of the foregoing disadvantages inherent in the known types of rackets with frames of various designs and configurations now present in the prior art, the present invention provides an improved tri-hollow racket with traverse ribs. As such, the general purpose of the present invention, which will be described subsequently in greater detail, is to provide a new and improved tri-hollow racket with traverse ribs apparatus and method which has all the advantages of the prior art and none of the disadvantages.

To attain this, the present invention essentially comprises a tennis racket with improved playing characteristics. The tennis racket has a frame fabricated of extruded aluminum with a common cross-section along its entire length. The frame has free ends with frame portions adjacent to the free ends shaped parallel with each other for a short extent to constitute a handle. The frame is shaped in a curved configuration remote from the handle with a central opening therewithin to form a head. The opening has a central axis. The frame is shaped with a transition zone between the head and the handle and a throat piece in the transition zone. The cross-section of the frame is of an exterior closed curved configuration with a major axis parallel with the central axis and a minor axis perpendicular to the major axis. The cross-section of the frame also has two interior ribs spaced from each other dividing the cross-sectional configuration into three linear openings with the ribs angled equally and oppositely with respect to the minor axis and forming an angle of about 15 degrees respect to the minor axis. The ribs are of a common length greater that the length of the minor axis within the frame. A plurality of holes extend through the head of the frame. A plurality of strings in a grid-like configuration extend through the holes in the head to define a hitting area. A pallet is located over on the handle for gripping by a user.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tri-hollow racket with traverse ribs which has all the advantages of the prior art rackets with frames of various designs and configurations and none of the disadvantages.

It is another object of the present invention to provide a new and improved tri-hollow racket with traverse ribs which may be easily and efficiently manufactured and marketed.

It is a further object of the present invention to provide a new and improved tri-hollow racket with traverse ribs which is of a durable and reliable construction.

An even further object of the present invention is to provide a new and improved tri-hollow racket with traverse ribs which is susceptible of a low cost of manufacture with regard to both materials and labor, and which accordingly is then susceptible of low prices of sale to the consuming public, thereby making such rackets with frames of various designs and configurations economically available to the buying public.

Still another object of the present invention is to enhance the performance characteristics, playability, feel, comfort, and durability of an extruded racket frame.

Lastly, it is an object of the present invention to provide a new and improved racket frame of extruded aluminum with a common cross-section along its entire length. The frame has free ends with frame portions adjacent to the free ends shaped parallel with each other to constitute a handle. The frame is shaped in a curved configuration remote from the handle with a central opening therewithin to form a head. The opening has a central axis. The frame is shaped with a transition zone between the head and the handle. The cross-section of the frame is of an exterior closed configuration with a major axis parallel with the central axis and a minor axis perpendicular to the major axis. The cross-section of the frame has two interior ribs spaced from each other to divide the cross-sectional configuration into three linear openings with the ribs being angled equally and oppositely with respect to each other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a force diagram illustrating the components of force on the frame of the prior Figures during operation and use.

FIG. 4 is a cross-sectional view of a frame constructed in accordance with an alternate embodiment of the invention.

Similar reference characters refer to similar parts throughout the several views of the drawings.

DESCRIPTION OF THE PREFERRED EMBODIMENT

Figure 1:
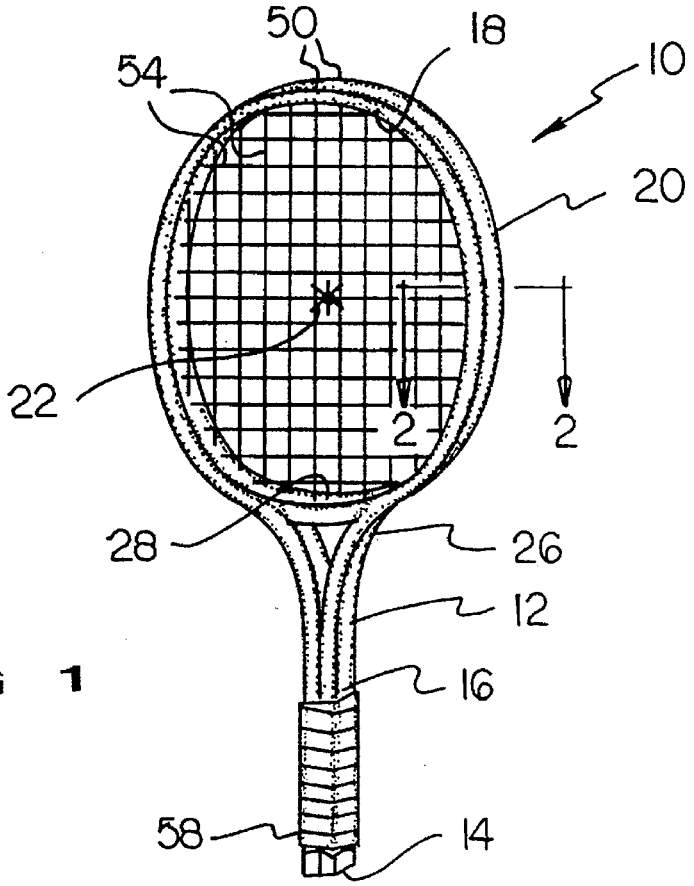
FIG. 1 is a perspective illustration of the preferred embodiment of the tri-hollow racket with traverse ribs constructed in accordance with the principles of the present invention.

With reference now to the drawings, and in particular to FIG. 1 thereof, a new and improved tri-hollow racket with traverse ribs embodying the principles and concepts of the present invention and generally designated by the reference numeral 10 will be described.

The present invention, the new and improved tri-hollow racket with traverse ribs, is comprised of a plurality of components. Such components in their broadest context include a frame, a plurality of holes, a plurality of strings and a pallet. Such components are individually configured and correlated with respect to each other so as to attain the desired objective.

The tennis racket of the present invention is a system 10. The tennis racket has a frame 12. The frame is fabricated of extruded aluminum with a common cross-section along its entire length.

The frame is configured to form free ends 14. The frame also has frame portions adjacent to the free ends shaped parallel with each other for a short extent to constitute a handle 16. The frame is shaped in a curved configuration remote from the handle with a central opening 18. The central opening forms a head 20. The opening has a central axis 22.

The frame is also shaped with a transition zone 26. The transition zone is located between the head and the handle. A throat piece 28 is located in the transition zone.

The cross-section of the frame is of an exterior closed curved configuration 30 with a major axis 32 parallel with the central axis. It also has a minor axis 34 perpendicular to the major axis. The cross-section of the frame also having two interior ribs 38, 40. The ribs are spaced from each other whereby they divide the cross-sectional configuration into three linear openings 42, 44, 46. The ribs are angled equally and oppositely with respect to the minor axis and form an angle of about 15 degrees with respect to the minor axis. The ribs are of a common length greater that the length of the minor axis within the frame. Next provided are a plurality of holes 50. The holes extend through the head of the frame.

Further provided in the system 10 of the present invention are a plurality of strings 54. The strings are in a grid-like configuration. The strings extend through the holes in the head to define a hitting area.

Next provided is a pallet 58. The pallet is of a conventional construction and is located over on the handle for gripping by a user.

Figure 2:
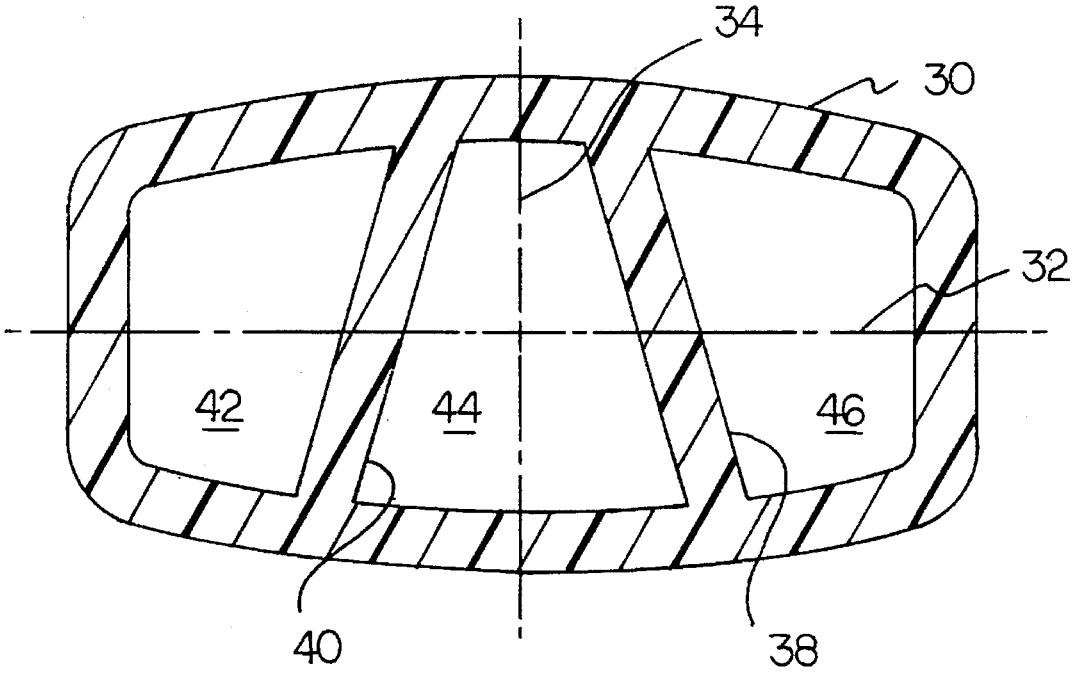
FIG. 2 is a cross-sectional view of a portion of the frame of the tennis racket shown in FIG. 1.
Figure 5:
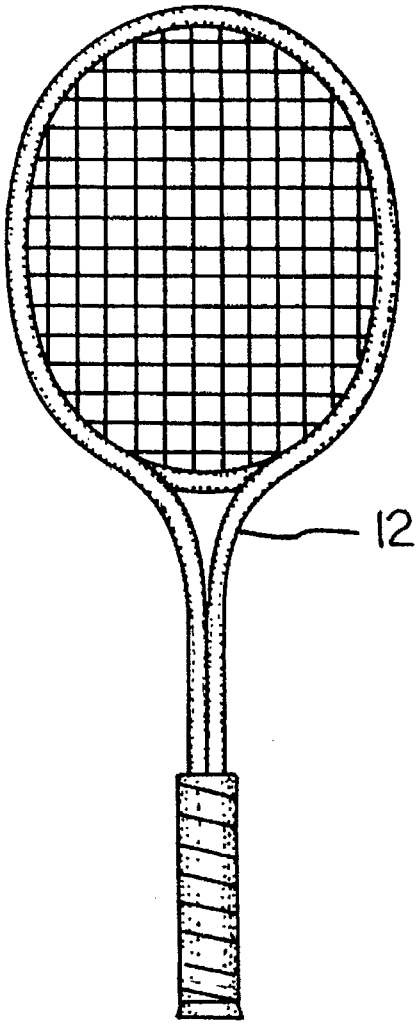
FIG. 5 is a front elevational view illustrating a tennis racket constructed in accordance with the primary embodiment of the invention.

In the primary embodiment of the invention as shown in FIGS. 1 and 2, the frame has a cross-section in a generally oval configuration. In an alternate embodiment of the invention as shown in FIG. 4, the cross-section of the frame 62 is of a generally rectangular configuration.

Figure 6:
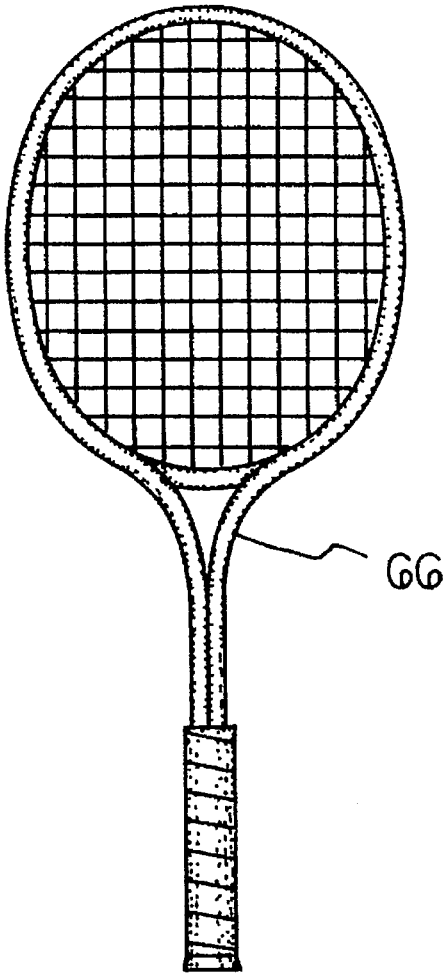
FIG. 6 is a front elevational view illustrating a tennis racket constructed in accordance with an alternate embodiment of the invention.

A further alternate embodiment of the invention is shown in FIG. 6. In such embodiment, the racket 66 is of an extended length. The overall length of such racket is about 28.5 inches while the longest length of a string in the opening in essential alignment with the axis of the handle is about 13.75 inches. The racket is thus over twice the length of the longest string. In contrast to this, the racket of the primary embodiment is of a more conventional length, about 27 inches with a head of essentially the same size of that of the alternate embodiment. In the primary embodiment, the length of the entire racket is less than twice the length of the longest string. These dimensions are for rackets having a head size of about 110 square inches.

The present invention is a game racket with a cantilever support where the player grips the racket. Generally, when a player strikes a ball, the racket, a cantilever beam, is reacted upon by a combined loading of bending and torsion as a result of the impact which occurs when the ball is struck. The present invention, although shown as a tennis racket, is equally applicable to other rackets, such as racquetball rackets, squash rackets and the like.

This combined loading of bending and torsion creates a stress/strain relationship within the racket body, a beam with compound curves, that determines the playability, feel and comfort the user experiences.

When a cantilever is subjected to combined loading and bending and torsion, the beam is loaded by a torque T and lateral force Q. Note FIG. 3.

More specifically, at any cross-section of the beam, the distance X from the support point, the stress resultants are (1) a bending moment M equal to Q (L-X) where L is the length of the beam; (2) a shear force V equal to Q; and (3) a twisting couple T.

In the case of a game racket, the stress resultants M and T, bending moment and twisting couple, and how the racket body reacts to these resultants are paramount in determining playability, feel, comfort and durability of the racket.

Performance, playability, feel and comfort are effected by transverse deflection of the racket body when the ball is struck. More specifically, the less the deflection, the more power imparted to the ball, the less angular twist, the more control and consistency the player will have in shot placement.

The resistance to transverse deflection and angular twist of a racket frame is best attained by designing the cross-section with optimized transverse and torsional stiffness. The cross-section design of the present invention optimizes transverse and torsional stiffness without having to make the cross-section bulky and overly wide.

The present invention is a generally oval or generally rectangular cross-section tubing with angular traverse ribs which combine optimum transverse stiffness with optimum torsional stiffness to outperform cross-sections of prior art having the same cross-sectional dimensions. Cross-sectional designs of prior art would have to be made bulkier and heavier in order to exhibit the same performance of the present invention. Hence, the present invention provides for a lighter, better performing racket than one of the prior art extrusion design.

It should be noted that the angular traverse inner ribs serve the dual purpose of making the racket body stiffer and more stable, both in bending and torsion.

The racket frame of the present invention demonstrates that rackets constructed with the closed exterior with angularly traverse ribbed cross-section, has a greater torsional stiffness, hence exhibits less angular twisting in play than prior art cross-section of the same dimension.

Various extruded profiles of various designs and configurations are known for various applications. The profiles as described herein are new for racket frame constructions. The application of such profile shapes, when used in non-linear configurations, such as rackets having curved shapes, has been found to provide new, useful and unobvious enhancements in performance characteristics. Such enhanced performance characteristics have been found to be surprisingly superior. Further, such profiles are applicable to essentially all extruded frames including frames clad with composite materials.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A tennis racket with improved playing characteristics comprising, in combination:

a frame fabricated of extruded aluminum with a common cross-section along its entire length, the frame having free ends with frame portions adjacent to the free ends shaped parallel with each other for a short extent to constitute a handle, the frame being shaped in a curved configuration remote from the handle with a central opening therewithin to form a head, the opening having a central axis, the frame also being shaped with a transition zone between the head and the handle and a throat piece in the transition zone, the cross-section of the frame being of an exterior closed curved configuration with a major axis parallel with the central axis and a minor axis perpendicular to the major axis, the cross-section of the frame also having two straight interior ribs of a common thickness throughout their lengths and spaced from each other dividing the cross-sectional configuration into three linear openings with the ribs being angled equally and oppositely with respect to the minor axis and forming common angles of about 15 degrees with respect to the minor axis along their entire lengths, the ribs being of a common length greater than the length of the minor axis within the frame;

a plurality of holes extending through the head of the frame;

a plurality of strings in a grid-like configuration extending through the holes in the head to define a hitting area; and a pallet located on the handle for gripping by a user.

2. A racket frame of extruded aluminum with a common cross-section along its entire length, the frame having free ends with frame portions adjacent to the free ends shaped parallel with each other to constitute a handle, the frame being shaped in a curved configuration remote from the handle with a central opening therewithin to form a head, the opening having a central axis, the frame also being shaped with a transition zone between the head and the handle, the cross-section of the frame being of an exterior closed configuration with a major axis parallel with the central axis and a minor axis perpendicular to the major axis, the cross-section of the frame also having two straight interior ribs of a common thickness throughout their lengths and spaced from each other to divide the cross-sectional configuration into three linear openings with the ribs being angled equally and oppositely with respect to each other along their entire lengths at angles of between about 10 and 20 degrees with respect to the minor axis to form a generally trapezoidal opening therebetween.

3. The frame as set forth in claim 2 wherein the cross-section of the frame is of a generally oval configuration.

4. The frame as set forth in claim 2 wherein the cross-section of the frame is of a generally rectangular configuration.

5. The frame as set forth in claim 2 wherein the length of the frame is about 27 inches.

6. The frame as set forth in claim 2 wherein the length of the frame is about 28.5 inches.

7. The frame as set forth in claim 2 wherein the length of the frame is less than twice the length of the longest string.

8. The frame as set forth in claim 2 wherein the length of the frame is greater than twice the length of the longest string.

* * * * *